United States Patent [19]

Rudolph et al.

[11] Patent Number: 4,516,588

[45] Date of Patent: May 14, 1985

[54] PROCESS FOR IMPROVING THE FILLING CAPACITY OF TOBACCO, IN PARTICULAR CUT TOBACCO LEAF

[75] Inventors: Gert Rudolph, Hamburg, Günther Rodemeyer, Seevetal, both of Fed. Rep. of Germany

[73] Assignee: B.A.T. Cigaretten Fabriken G.M.B.H, Hamburg, Fed. Rep. of Germany

[21] Appl. No.: 454,373

[22] Filed: Dec. 29, 1982

[30] Foreign Application Priority Data

Jan. 8, 1982 [DE] Fed. Rep. of Germany ..... 3200305

[51] Int. Cl.[3] ..... A24B 3/18

[52] U.S. Cl. ..... 131/291; 131/310; 131/352

[58] Field of Search ..... 131/352, 291, 292, 293, 131/294, 295, 296, 900, 901, 902, 903, 310

[56] References Cited

U.S. PATENT DOCUMENTS 4,243,056 1/1981 de la Burde .

FOREIGN PATENT DOCUMENTS 2143388 7/1975 Fed. Rep. of Germany .
2506100 8/1975 Fed. Rep. of Germany .
2503636 8/1975 Fed. Rep. of Germany .
1917552 4/1976 Fed. Rep. of Germany .
2903300 7/1980 Fed. Rep. of Germany .
1331640 5/1976 United Kingdom .

OTHER PUBLICATIONS

Leffingwell et al., Tobacco Flavoring for Smoking Products (1972).

The Chemistry & Technology of Food & Food Products, ed., Morris B. Jacobs (1951).

*Primary Examiner*—V. Millin

*Attorney, Agent, or Firm*—Arnold, White & Durkee

[57] ABSTRACT

The impairment of the taste of smoke, observed in processes for improving the filling capacity of tobacco by expansion of the tobacco with a vaporizable expanding agent, can be avoided if an anti-oxidant, in particular ascorbic acid, is added to the tobacco before the expansion. In addition, anti-oxidant synergists can also be added.

9 Claims, No Drawings

PROCESS FOR IMPROVING THE FILLING CAPACITY OF TOBACCO, IN PARTICULAR CUT TOBACCO LEAF

FIELD OF THE INVENTION

The invention relates to a process for improving the filling capacity of tobacco, in particular cut tobacco leaf, in which raw tobacco is moistened, stripped and cut, and, after impregnation with a vaporizable expanding agent, is subjected to either a reduction in pressure, an increase in temperature or both.

BACKGROUND

At harvesting, tobacco leaves contain a considerable quantity of water. After harvesting, this water is removed by various drying processes, as a result of which the leaf structure shrinks. During the usual processes for preparing tobacco for the manufacture of cigarettes and cigars, the tabacco regains, if any, only a small part of the original volume, so that a considerable loss in the filling capacity of the tobacco results. Due to this shrinkage the tobacco has a higher volume density than that required for the manufacture of cigarettes of satisfactory quality.

Numerous processes are known to improve the filling capacity of tobacco. This process is also known as tobacco expansion. It is common to these processes that the tobacco which is to be expanded is impregnated under defined pressure and temperature conditions with a volatile auxiliary. This auxiliary or flowing agent is then vaporized by supplying heat, reducing the pressure or both. The increase in the volume of the auxiliary, which then takes place, effects the expansion of the tobacco. The known processes for expanding tobacco differ primarily in the nature of the auxiliaries (blowing agents) which are employed. For example, the process according to German Patent Specification No. 1,917,552 uses volatile organic liquids, the process according to German Patent Specification No. 2,143,388 uses a mixture of ammonia and carbon dioxide, the process according to German Offenlegungsschrift No. 2,503,636 uses carbon dioxide and the process according to German Offenlegungsschrift No. 2,903,300 uses nitrogen or argon.

A substantial disadvantage of the processes mentioned above is that, although they lead to a useful expansion of the tobacco, the taste of the smoke from the tobaccos thus expanded is considerably impaired by the process. Not only is the taste intensity diminished, but the tobaccos treated in this way also have unfavorable taste features which, according to the statements of experts, can be described by the occurrence of less desirable taste notes, described as bitter, metallic, musty or rancid. Since the expanded tobaccos did not have these undesirable taste characteristics before their treatment, obviously they are caused by the treatment.

It is a generally known practice to treat tobacco leaves, before cutting, to improve or enrich the taste, with substances, such as sugar, liquorice, cacao, fruity syrups and the like. It is also known to add aroma substances to the finally cut tobacco for this purpose. For this purpose, natural and synthetically produced essences of any type, identical to the natural ones, or individual aroma substances, such as menthol or vanillin, are employed. The list of the substances and essences which can be used for this purpose is extensive. See e.g., the listing by Leffingwell et al., Tobacco Flavouring for Smoking Products, 1972. However, tests have shown that, in the case of expanded tobacco, the above described undesired taste properties caused by the expansion can be avoided, eliminated or covered only to a very unsatisfactory extent, if at all, by the conventional additions of aroma substances or flavorings either to the tobacco leaf or to cut tobacco.

SUMMARY OF THE INVENTION

The taste characteristics of tobacco expanded by being subjected to either a reduction in pressure, an increase in temperature or both after having been impregnated with a vaporizable expanding agent are improved by adding an anti-oxidant to the tobacco prior to the expansion. Additional anti-oxidant synergists can be added.

DESCRIPTION

Surprisingly, it has now been found that the formation of the above-described undesired taste features caused by the expansion can be completely prevented, by adding an anti-oxidant to the tobacco before expansion.

To achieve the desired effect, it is absolutely necessary to add these substances to the tobacco before the expansion step, for example during or after the moistening or stripping of the tobacco leaves, preferably after stripping or after cutting. A later addition of the anti-oxidant to already expanded cut tobacco does not have any influence on the undesired taste notes.

Ascorbic acid has proved to be most suitable for the present purpose, and is therefore the preferred anti-oxidant but other substances which are known to prevent or delay the autoxidation of foodstuffs and essences also give a taste-improving effect. Substances having such properties are known; listings are to be found, for example, in Aebi et al., Kosmetika, Riechstoffe and Lebensmittelzusatzstoffe, [Cosmetics, Fragrances and Food Additives], Thieme Verlag, 1978, pages 86–102.

The taste-preserving effect of the present invention is the more unexpected, because these substances, to which an activity preventing the oxidation of foodstuffs and essences is ascribed, occur in tobacco as natural constituents. Examples of such constituents are ascorbic acid, pectins, aminoacids, in particular proline, caffeic acid, ferulic acid and chlorogenic acid, and also quercetin derivatives, such as rutin. Other examples include alpha-tocopherol and gamma-tocopherol. Therefore, it was not expected that a later or additional application of such substances would have a taste-preserving effect. In particular, the taste-preserving effect of ascorbic acid was surprising, since no activity is ascribed to this substance in the abovementioned listing by Leffingwell et al.

Examples of suitable anti-oxidant which do not occur naturally in tobacco include 2-tert, butyl-4-hydroxyanisole and 3,5-di-tert.-butyl-4-hydroxy-toluene. In addition, compounds such as eugenol and isoeugenol are also acceptable. It is uncertain whether these two compounds occur naturally in tobacco.

According to the invention, the taste-preserving effect can be achieved by small added quantities. Thus, added quantities of 0.001% by weight to less than 0.1% by weight, in particular 0.001 to less than 0.1% by weight, relative to the dry tobacco weight (weight prior to moistening), are sufficient to obtain the taste-preserving activity.

Preferably, the substances employed as the anti-oxidants are natural tobacco constituents like those mentioned above. The addition of ascorbic acid is particularly preferred.

In the process of the invention, substances can also be employed which are known to promote or boost the activity of anti-oxidants for foodstuffs and aroma substances or essences. Such substances, termed synergists, are know; listings are likewise to be found in the above-mentioned publication. Monobasic or polybasic monohydroxy- or polyhydroxy-carboxylic acids, such as lactic acid, tartaric acid, citric acid or the like, have proved to be most suitable for the present purposes. The added quantity of these substances can vary over a range from 0.001% to 2% by weight, relative to dry tobacco weight. The preferred range is 0.05 to 2% by weight. Moreover, a combination of ascorbic acid and citric acid is particularly preferred.

Further preferred features of the process of the invention will be evident from the examples which follow and the claims.

EXAMPLE 1

5 kg of a stripped Virginia tobacco leaf mixture was sprayed with 0.4 liters of water and thus brought to a tobacco moisture content of about 20%. The tobacco was then cut and subjected to an expansion process with liquid $CO_2$ as the blowing agent. Filter cigarettes of 84 mm length were then produced from the finished expanded tobacco. The taste of these cigarettes was assessed by an expert team in comparison with a cigarette of the same, but unexpanded tobacco mixture. In the view of the experts, the taste of the smoke from the cigarette containing the expanded tobacco was altogether more flat, and, in addition, had marked unpleasant bitter, metallic, musty and rancid taste notes, which the untreated tobacco did not have.

EXAMPLE 2

5 kg of the tobacco mixture used in Example 1 were sprayed with a solution of 4 g of ascorbic acid in 0.4 liters of water. This tobacco was then treated further as described in Example 1. The taste of the cigarettes produced from this expanded tobacco was rated by an expert team, in comparison with the cigarette from Example 1, as being more aromatic and qualitatively altogether substantially better, and there were no unfavorable taste properties at all.

EXAMPLE 3

5 kg of the tobacco mixture used in Example 1 were sprayed with a solution of 2 g of ascorbic acid and 10 g of citric acid in 0.4 liters of water. The tobacco was then treated further as described in Example 1. The taste of the test cigarettes produced from this expanded tobacco was rated, in comparison with the cigarette from Example 1, as being more aromatic, having less irritant and being qualitatively substantially better. Also, in this cigarette, the undesired taste features typical of the cigarette from Example 1 were no longer noticeable.

EXAMPLE 4

5 kg of the stripped tobacco mixture used in Example 1 were sprayed with a solution of 0.25 g of 3,5-di-tert.-butyl-4-hydroxy-toluene (BHT) in 50 g of ethanol. After evaporation of the ethanol, the tobacco was then sprayed with 0.4 liters of water and treated further as described in Example 1. The taste of the cigarettes produced from this expanded tobacco was rated by an expert team, in comparison with the cigarette from Example 1, as being more aromatic and altogether substantially better. There were no unfavorable taste notes at all.

EXAMPLE 5

250 g of the expanded tobacco from Example 1 were sprayed with a solution of 0.1 g of ascorbic acid in 10 ml of water. After careful drying of the tobacco thus treated to the original moisture content, cigarettes were produced. Compared with the cigarettes from Example 1, the taste of the smoke from these cigarettes did not show any improvement in taste at all; the unpleasant taste notes described were still clearly perceivable.

This example shows that the process according to the invention for preserving the tobacco aroma has the desired effect only if it is applied before the expansion process.

Although in the foregoing examples the anti-oxidant was added between the stripping and cutting steps, it may also be added after cutting.

Modification and variations of the invention will be apparent to those skilled in the art. Applicants intend to cover all such equivalent modification and variations as fall within the true spirit and scope of the invention.

What is claimed is:

1. In a process for improving the filling capacity of tobacco for use in cigarettes or cigars in which raw tobacco is moistened, stripped and cut and, after impregnation with a vaporizable expanding agent, is subjected to an expansion process, the improvement which comprises adding an anti-oxidant, in the amount of 0.0001% to less than 0.1% by weight relative to the raw tobacco weight, to the tobacco before said expansion.

2. The process of claim 1 wherein said anti-oxidant is chosen from among the natural constituents of tobacco.

3. The process of claim 2 wherein said anti-oxidant is ascorbic acid.

4. The process of claim 1 wherein said anti-oxidant is 3,5-di-tert.-butyl-4-hydroxy-toluene.

5. The process of claim 1 wherein said anti-oxidant is added to said tobacco after stripping.

6. The process of claim 1 wherein said anti-oxidant is added to said tobacco after cutting.

7. The process of claim 1 wherein said expansion of said tobacco comprises subjecting said impregnated tobacco to a reduction in pressure.

8. The process of claim 1 wherein said expansion of said tobacco comprises subjecting said impregnated tobacco to an increase in temperature.

9. The process of claim 1 wherein said expansion of said tobacco comprises subjecting said impregnated tobacco to both a reduction in pressure and an increase in temperature.

* * * * *